US008429777B2

(12) United States Patent
Svoboda

(10) Patent No.: US 8,429,777 B2
(45) **Date of Patent: *Apr. 30, 2013**

(54) MATTRESS ENCASEMENT

(75) Inventor: Michael A. Svoboda, Prosper, TX (US)

(73) Assignee: GBS Enterprises, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/445,628

(22) Filed: Apr. 12, 2012

(65) Prior Publication Data

US 2012/0192356 A1 Aug. 2, 2012

Related U.S. Application Data

(63) Continuation of application No. 12/590,062, filed on Nov. 2, 2009, now Pat. No. 8,156,588.

(51) Int. Cl.
*A47C 31/00* (2006.01)

(52) U.S. Cl.
USPC ..... 5/699; 5/738; 5/939; 5/496; 5/737; 5/484; 5/501; 5/499

(58) Field of Classification Search ..... 5/699, 738, 5/939, 496, 737, 482, 484, 501, 499; 24/389, 24/306, 442, 397, 398, 433, 432
See application file for complete search history.

(56) References Cited

U.S. PATENT DOCUMENTS

| | | | |
|---|---|---|---|
| 3,538,914 | A | 11/1970 | Myers |
| 5,513,403 | A | 5/1996 | Wooten, Jr. |
| 6,363,553 | B1 | 4/2002 | Baumgartel et al. |
| 7,552,489 | B2 | 6/2009 | Bell et al. |
| 2008/0250561 | A1 | 10/2008 | Poston |
| 2009/0049608 | A1 | 2/2009 | Bell et al. |
| 2010/0054637 | A1 | 3/2010 | Tirpan |

*Primary Examiner* — William Kelleher
(74) *Attorney, Agent, or Firm* — Greer, Burns & Crain, Ltd.

(57) ABSTRACT

An improved encasement for a mattress which thwarts the escapement of bed bugs from a mattress through the encasement and which thwarts the encroachment of beg bugs through the encasement into the mattress. An elongated opening is provided in the encasement which is selectively closed by a zipper associated therewith. The encasement includes a flap secured to the lower side wall portion of a side of the encasement which is positioned inwardly of the zipper for retarding or preventing the escapement of bed bugs through the zipper. Hook and loop fasteners are also provided at the end location for further preventing the escapement of bed bugs from the mattress through the encasement and preventing the encroachment of beg bugs into the mattress through the encasement.

17 Claims, 5 Drawing Sheets

MATTRESS ENCASEMENT

PRIORITY CLAIM

This application is a continuation of application Ser. No. 12/590,062, filed Nov. 2, 2009.

BACKGROUND OF THE INVENTION

1. Field of the Invention

This invention relates to a mattress encasement and more particularly to a mattress encasement for preventing bed bug escapement through a zipper opening in the encasement or bed bug encroachment through the zipper opening.

2. Description of the Related Art

Bed bug infestation in mattresses is a growing concern. Many attempts have been provided to prevent the bed bugs from moving from an infested mattress to bed clothing where the bed bugs feast on an individual sleeping in the bed. If the mattress encasement did not have zippers formed therein to facilitate the positioning of the mattress within the encasement, the movement of the bed bugs from the mattress would be thwarted since the encasement is comprised of a bed bug impervious material. However, a mattress encasement must be periodically removed from the mattress for laundering which makes it imperative that zippers be utilized. Even though the teeth of the zipper tracks of the mattress encasements are very small in size to thwart the movement of bed bugs therethrough, bed bugs still pass through the zipper tracks. One attempt to prevent the escapement of bed bugs from a mattress through a mattress encasement is disclosed in U.S. Pat. No. 7,552,489. Although it is believed that the mattress encasement described in U.S. Pat. No. 7,552,489 does reduce the movement of bed bugs from the mattress through the zipper, Applicant has developed an improved mattress encasement which is regarded as a dramatic improvement over the '489 Patent and the other prior art encasements.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A bed bug protective encasement for a mattress having six sides is described. The encasement comprises a cover of a size for surrounding the six sides of the mattress and is formed of a bed bug impervious fabric. The cover has an opening formed therein which is of such a shape for receiving the mattress within the cover. A slide fastening mechanism is disposed in the opening in the cover which is operable to close the opening after the mattress has been received in the cover. The slide fastening mechanism comprises a zipper head and a pair of zipper tracks having a longitudinal axis and terminating at an end location. The opening in the mattress extends completely along one side of the mattress and at least partially along one or more adjacent sides. The opening defines a generally vertically disposed upper side wall portion, having a lower end, in the said one side and the said adjacent side or sides and defining a generally vertically disposed lower side wall portion having an upper end, in the said one side and the said one or more sides. The upper and lower side wall portions have inner and outer surfaces. A first zipper track is secured to the lower end of the upper side wall portion. A second zipper track is secured to the upper end of the lower side wall portion. The first and second zipper tracks terminate at an end location and have a zipper head connected thereto operable to close the opening.

The cover also includes an elongated flap having an upper end and a lower end with the flap being formed with a bed bug impervious material. The lower end of the flap is secured to the lower side wall portion and extends upwardly therefrom inwardly of the inside surface of the lower side wall portion so that the upper end of the flap is positioned above the-first zipper track and so that the upper end of the flap is positioned above the zipper tracks when the opening has been closed. The flap has a strip of loop fastener material secured thereto at the end location which faces the inner surface of the upper side wall portion. The upper side wall portion has a strip of hook fastener material secured thereto at the inner surface thereof at the end location above the second zipper track. The hook and loop fastener material and the flap cooperate to prevent bed bugs from moving through the opening and zipper at the end location.

It is therefore a principal object of the invention to provide an improved mattress encasement.

A further object of the invention is to provide an improved mattress encasement for preventing bed bug escapement and encroachment through a zipper opening in the encasement.

A further object of the invention is to provide a mattress encasement which includes a flexible flap positioned at the inner side of the zipper.

A further object of the invention is to provide a mattress encasement which includes hook and loop fasteners at the end location to thwart the movement of bed bugs through the zipper at the end location.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
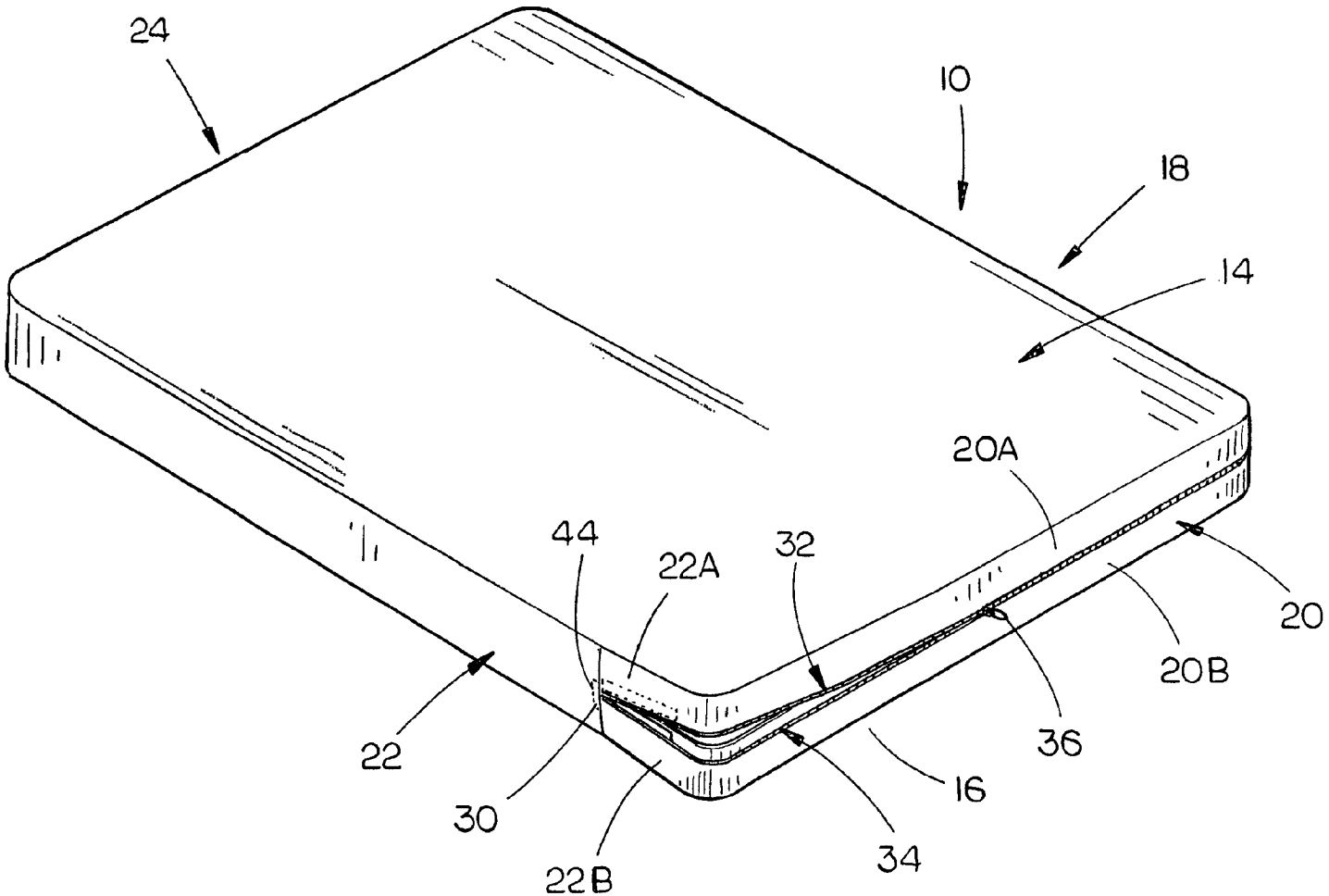
FIG. 1 is a perspective view of the mattress encasement of this invention with the zipper being partially open.
Figure 2:
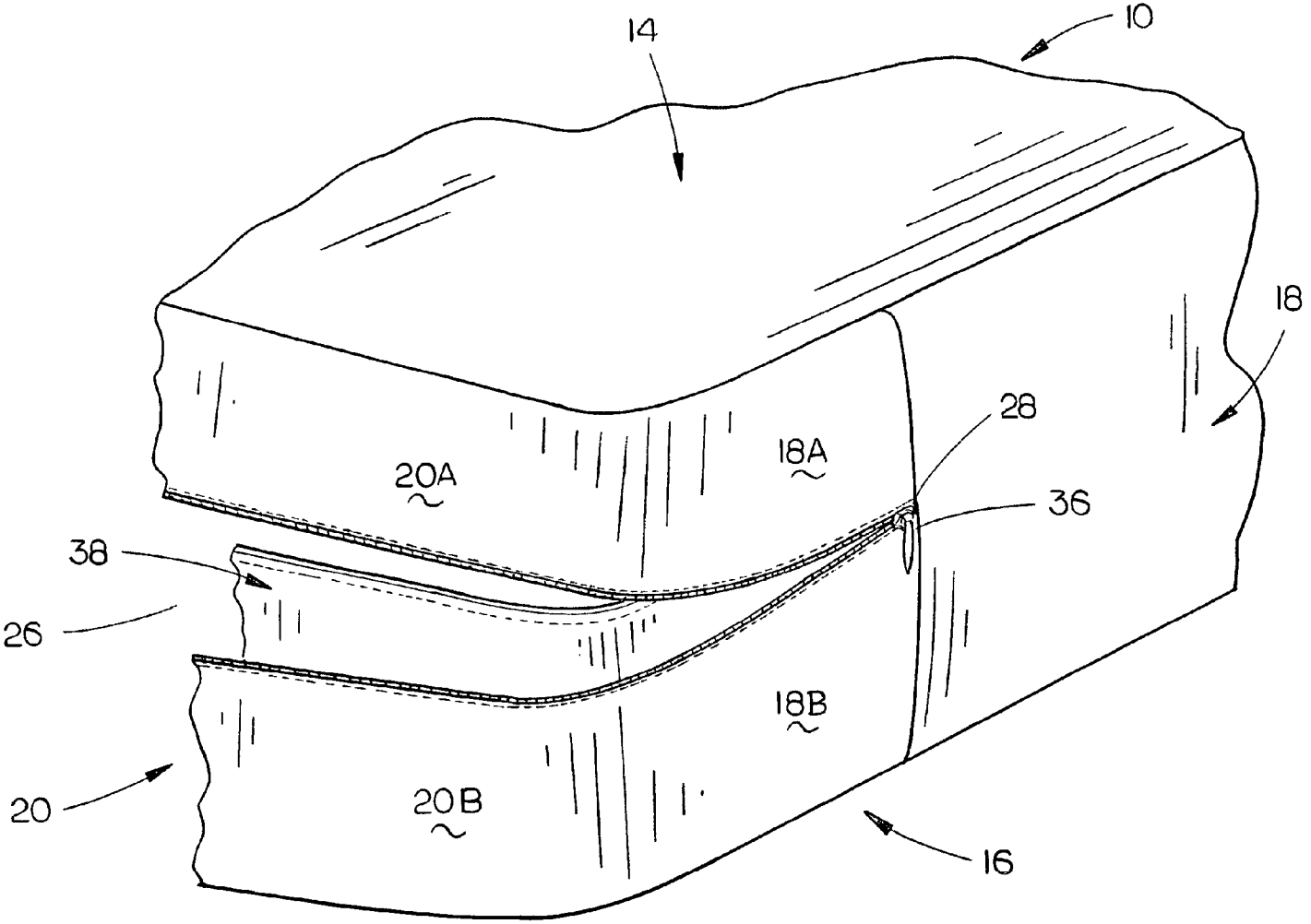
FIG. 2 is a partial perspective view illustrating one end of the zipper opening and the flap extending upwardly from the lower side wall portion.
Figure 3:
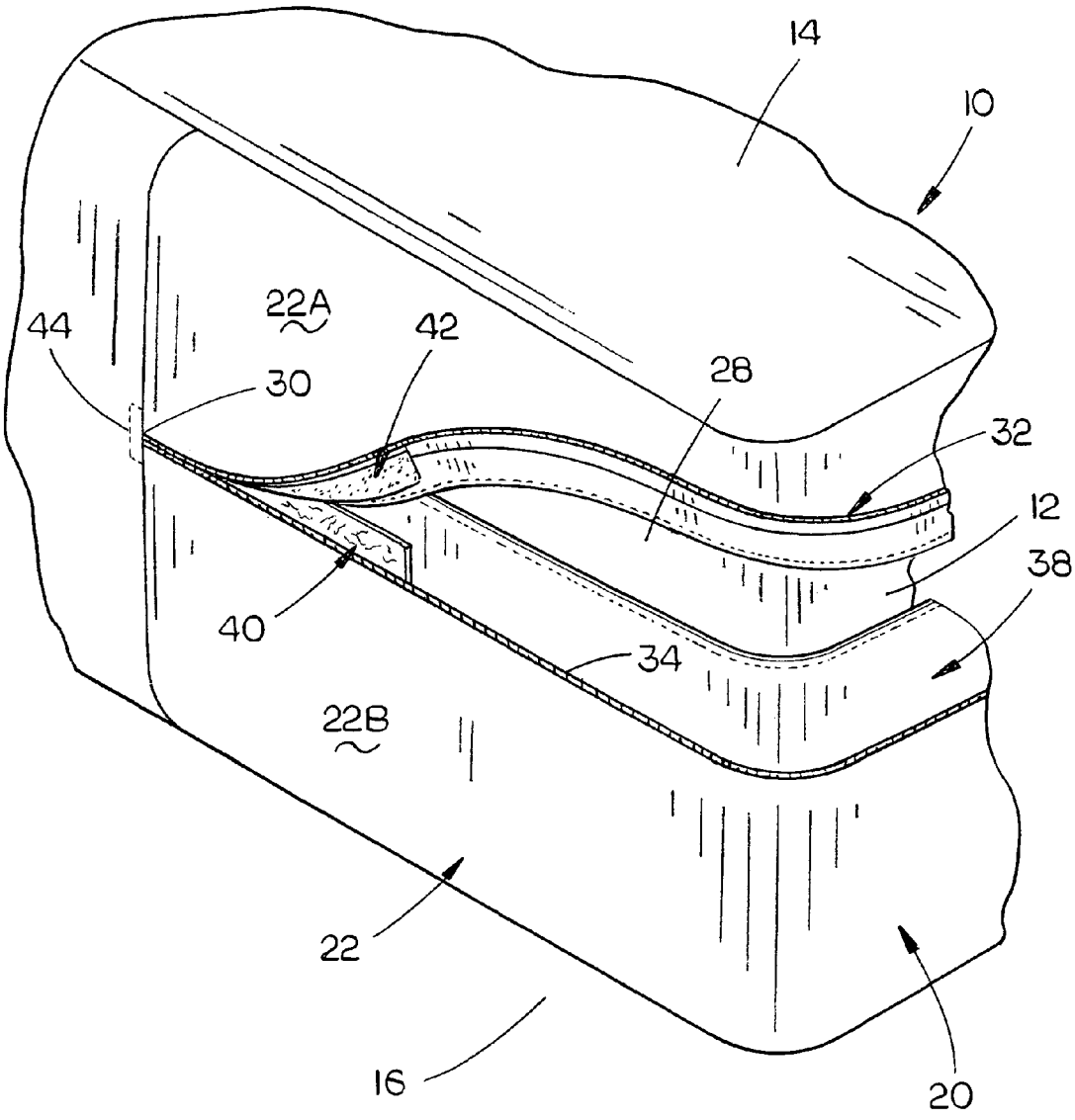
FIG. 3 is a partial perspective view seen at the other end of the zipper track with the zipper being opened to illustrate the hook and loop fasteners provided at the end location.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the bed bug encasement of this invention for encasing a mattress 12. Encasement 10 is comprised of a bed bug impervious fabric material readily available in the marketplace. Encasement 10 includes a top side 14, a bottom side 16, and sides 18, 20, 22 and 24 extending therebetween. Encasement 10 has an elongated opening 26 formed therein which has a length sufficient to enable the mattress to be received within the encasement. In the particular embodiment shown herein, the opening 26 is formed in encasement 10 at the end of side 18, the entire length of side 20, and at one end of side 22. For purposes of description, opening 20 will be described as having ends or end locations 28 and 30. Also, for purposes of description, opening 26 will be described as creating an upper side wall portion 18A and lower side wall portion 18B in side 18, an upper side wall portion 20A and lower side wall portions 20B in side 20, and an upper side wall portion 22A and lower side wall portion 22B in side 22.

Zipper track 32 is attached to the lower ends of lower side wall portions 18A, 20A and 22A by sewing or stitching and extends between end locations 28 and 30 of opening 26. Zipper track 34 is attached to the upper ends of lower side wall portions 18B, 20B and 22B by sewing or stitching and extends between end locations 28 and 30 of opening 26. Zipper head 36 is mounted on zipper tracks 32 and 34 in conventional fashion. When zipper head 36 is at end location 28, the zipper tracks 32 and 34 will be "open" or disconnected. When zipper head 36 is at end location 30, the zipper tracks 32 and 34 will be engaged to close opening 26. The teeth of zipper tracks 32 and 34 are extremely small to thwart bed bug movement therethrough.

An elongated flexible flap 38 comprised of a bed bug impervious fabric is secured to the upper ends of lower side wall portions 18B, 20B and 22B, by stitching and extends upwardly therefrom to a point well above the zipper track 34 between end locations 28 and 30 of opening 26.

An elongated flat strip of loop fastener material 40 is secured to flap 38 (FIG. 4) at the outer surface thereof at end location 30 by stitching and extends therefrom for several inches.

Figure 4:
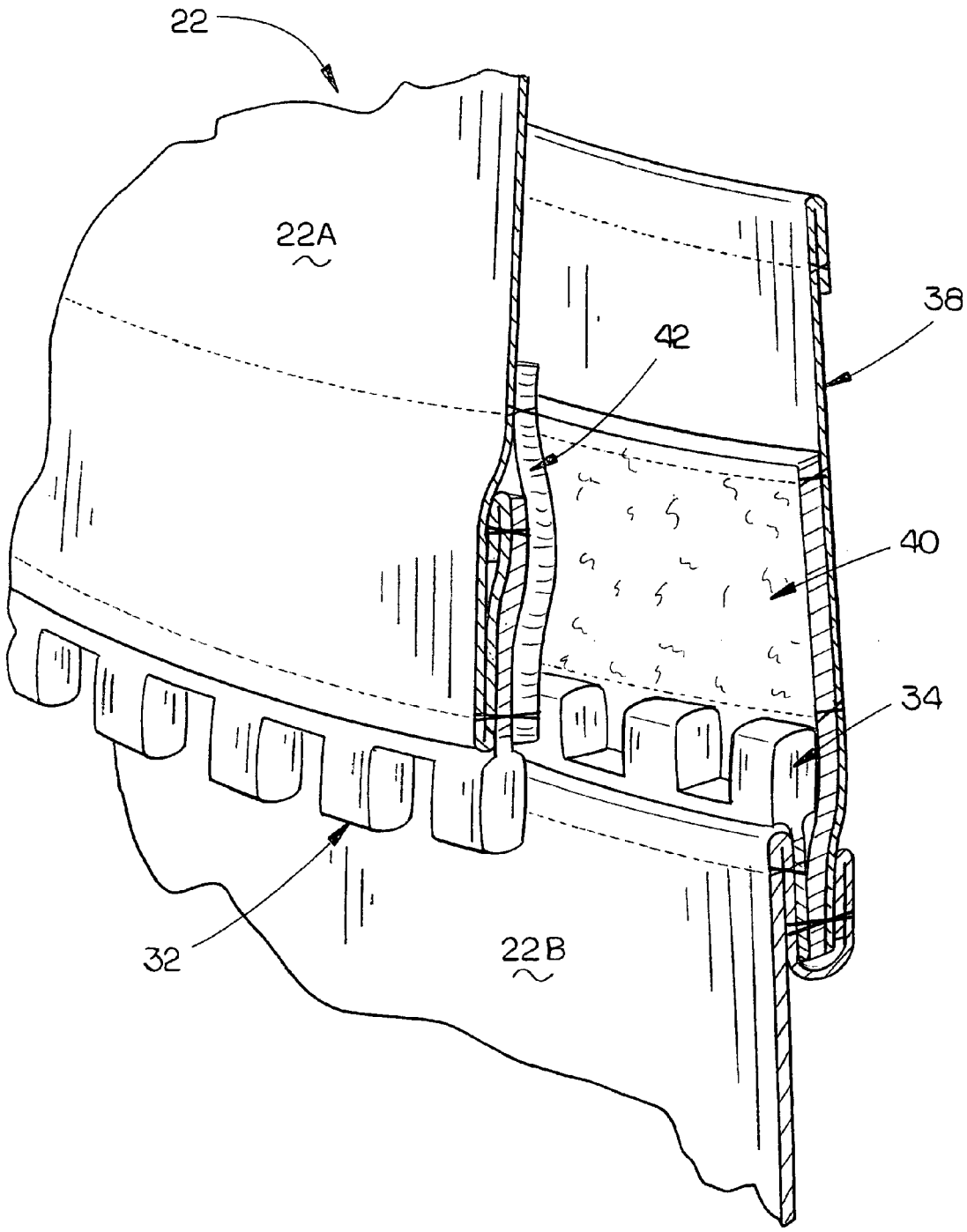
FIG. 4 is a partial perspective view illustrating the manner in which the hook and loop fasteners of the upper end lower side wall portions of the cover are attached thereto.
Figure 5:
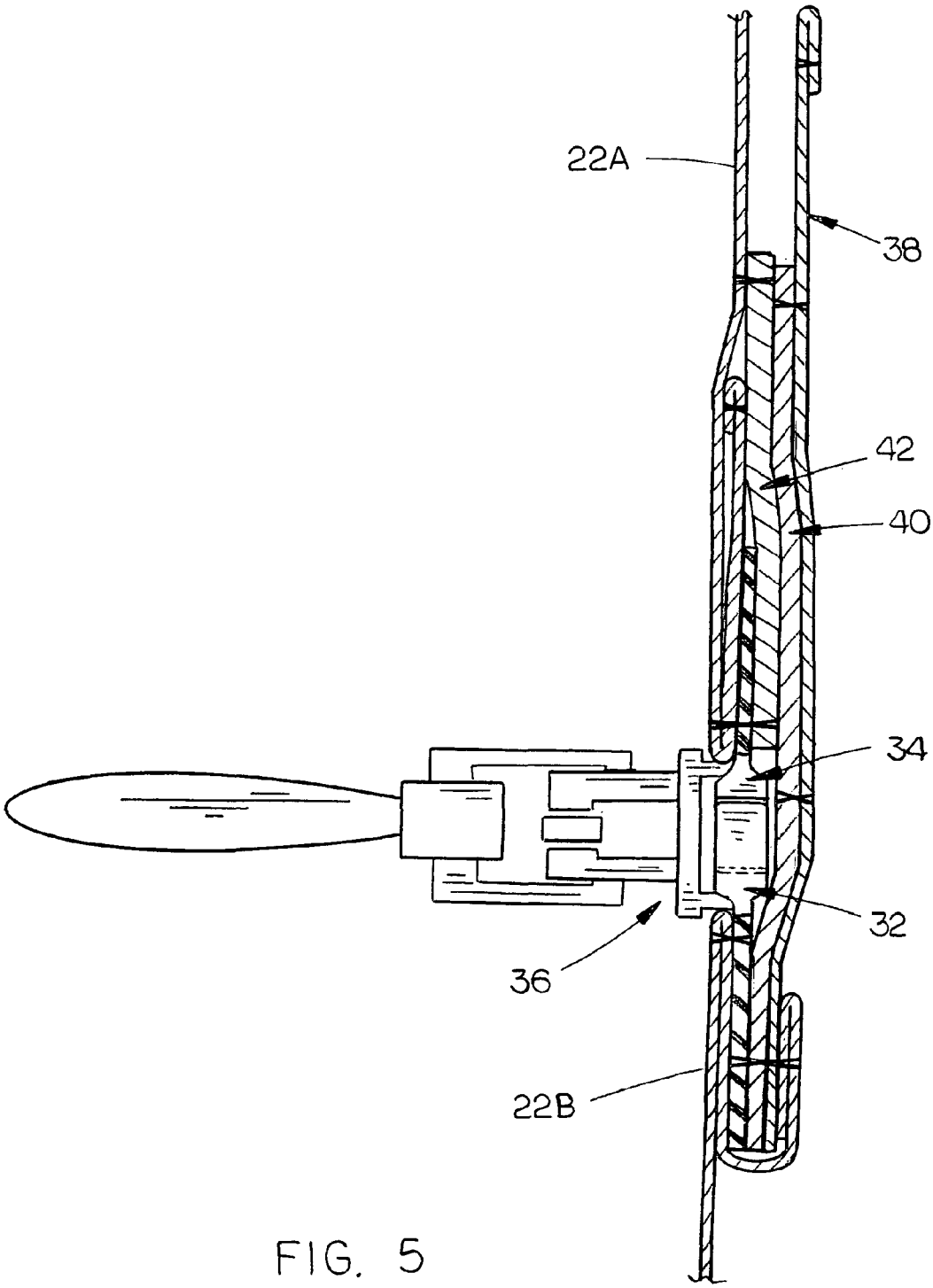
FIG. 5 is a sectional view illustrating the construction at the end location of the encasement.

An elongated flat strip of hook fastener material 42 is positioned at the inner surface of upper side wall portion 22A of side 22 at end location 30 and is secured thereto by stitching as seen in FIG. 4 and extends therefrom for several inches. It should be noted that strip 40 could be of hook fastener material with strip 42 being comprised of loop type fastener material.

When the mattress 12 has been inserted into the encasement 10 through opening 26, the flap 38 will be pushed or forced outwardly into close engagement with the zipper tracks 32 and 34. Upon closing of the opening 26, the bed bug impervious fabric material of flap 38 will thwart the movement of bed bugs through the zipper. When the zipper head 36 has been moved to its closed position at end location 30, the hook and loop fasteners will be engaged to further thwart movement of bed bugs through the end location 30 where zipper head 36 is positioned. The stitching 44 closes the ends of the strips 40 and 42.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A bed bug protective encasement for a mattress having six sides, comprising:

a cover of a size for surrounding the six sides of the mattress;

said cover having a top side, a bottom side and four sides interconnecting said top side and bottom side to define an interior of said cover and an exterior of said cover;

said cover being formed of a bed bug impervious fabric;

said cover having an elongated opening having a first end location and a second end location formed therein being of a size for receiving the mattress in said interior of said cover;

said opening defining a first wall portion having an end along said opening and an inner surface facing said interior of said cover and a second wall portion having an end along said opening and having an inner surface facing said interior of said cover;

a first zipper track with first and second elongated edges extending from said first end location of said opening to said second end location of said opening;

said first zipper track having spaced apart zipper teeth along said first elongated edge thereof which faces said opening;

said first zipper track being secured to said end of said first wall portion along said second elongated edge of said first zipper track which faces away from said opening;

a second zipper track with first and second elongated edges extending from said first end location of said opening to said second end location of said opening;

said second zipper track having spaced apart zipper teeth along said first elongated edge thereof which faces said opening;

said second zipper track being secured to said second wall portion along said second elongated edge of said second zipper track which faces away from said opening;

said first and second zipper tracks and the zipper teeth thereon having inner sides facing said interior of said cover and outer sides facing said exterior of said cover;

a zipper head connecting said first and second zipper tracks operable to close said opening;

said zipper head having an inner side facing said interior of said cover and an outer side facing said exterior of said cover;

said zipper head being positioned at said second end location of said opening when said opening has been closed;

an elongated flexible flap having an inner side facing said interior of said cover, an outer side facing opposite said inner side, a first elongated edge and a second elongated edge;

said flap being formed of a bed bug impervious material;

said flap being secured adjacent its said first elongated edge to said second wall portion adjacent said second elongated edge of said second zipper track and extending therefrom inwardly of said second side wall portion and inwardly of said zipper tracks toward said first zipper track so that said second edge of said flap is positioned beyond said second elongated edge of said first zipper track when said opening has been closed such that said outer side of said flap faces and overlies said inner surface of said first wall portion;

a strip of loop fastener material having a first edge and a second edge;

a strip of hook fastener material having a first edge and a second edge;

said first edge of one of said loop fastener material and said hook fastener material being secured to said flap and to said edge of said second wall portion adjacent said second edge of said second zipper track;

said second edge of said one of said loop fastener material and said hook fastener material being secured to said outer side of said flap which faces the inner surface of said first wall portion, said second edge of said one of said loop fastener material and said hook fastener material being secured to a portion of said flap which can be positioned at said second edge of said first zipper track;

said first edge of the other of said strip of loop fastener material and said hook fastener material being secured to said inner surface of said first wall portion adjacent said second edge of said first zipper track at said second end location of said opening;

said second edge of the other of said strip of loop fastener material and said hook fastener material being secured to said end of said first wall portion secured to said first zipper track;

said flap and said strip of said one of said loop fastener material and said hook fastener material providing a bed bug barrier at the inner side of the zipper teeth of said second zipper track when said zipper head is positioned at said end location;

the engagement of said strip of loop fastener material at said strip of hook fastener material forming an additional bed bug barrier above adjacent said zipper teeth of said first and second zipper tracks when said zipper head is positioned at said second end location of said opening.

2. The bed bug protective encasement according to claim 1, wherein said opening in said cover extends completely along one of said four sides and at least partially along an adjacent one of said four sides.

3. The bed bug protective encasement according to claim 1, wherein said opening in said cover is formed in at least one of said four sides.

4. The bed bug protective encasement according to claim 1, wherein said opening in said cover is formed in at least two of said four sides.

5. The bed bug protective encasement according to claim 1, wherein said opening in said cover is formed in at least three of said four sides.

6. The bed bug protective encasement according to claim 3, wherein said first wall portion is located above said second wall portion.

7. The bed bug protective encasement according to claim 1, wherein said strip of loop fastener material is secured to said flap.

8. The bed bug protective encasement according to claim 1, wherein said first zipper track is attached to said first wall portion by stitching.

9. The bed bug protective encasement according to claim 1, wherein said second zipper track is attached to said second wall portion by stitching.

10. The bed bug protective encasement according to claim 1, wherein said strip of loop fastener material is an elongated flat strip.

11. The bed bug protective encasement according to claim 1, wherein said strip of hook fastener material is an elongated flat strip.

12. The bed bug protective encasement according to claim 1, wherein said teeth of said first and second zipper tracks are extremely small to thwart bed bug movement therethrough.

13. The bed bug protective encasement according to claim 1, wherein said flap is secured adjacent its said first elongated edge to said second wall portion by stitching.

14. The bed bug protective encasement according to claim 7, wherein said strip of loop material is secured to said flap by stitching.

15. A bed bug protective encasement for a mattress having six sides, comprising:

a cover of a size for surrounding the six sides of the mattress;

said cover being formed of a bed bug impervious fabric and having a top side, a bottom side and four sides interconnecting said top side and bottom side to define an interior of said cover and an exterior of said cover;

said cover having an elongated opening having a first end location and a second end location formed therein being of a size for receiving the mattress in said interior of said cover;

said opening defining a first wall portion having an end along said opening and an inner surface facing said interior of said cover and a second wall portion having an end along said opening and having an inner surface facing said interior of said cover;

a first zipper track with first and second elongated edges extending from said first end location of said opening to said second end location of said opening;

said first zipper track having spaced apart zipper teeth along said first elongated edge thereof which faces said opening;

said first zipper track being secured to said end of said first wall portion by stitching along said second elongated edge of said first zipper track which faces away from said opening;

a second zipper track with first and second elongated edges extending from said first end location of said opening to said second end location of said opening;

said second zipper track having spaced apart zipper teeth along said first elongated edge thereof which faces said opening;

said second zipper track being secured to said second wall portion by stitching;

said first and second zipper tracks and the zipper teeth thereon having inner and outer sides;

a zipper head having an inner side facing said interior of said cover and an outer side facing said exterior of said cover, said zipper head connecting said first and second zipper tracks operable to close said opening;

said zipper head being positioned at said second end location of said opening when said opening has been closed;

an elongated flexible flap formed of a bed bug impervious material having an inner side facing said interior of said cover, an outer side facing opposite said inner side, a first elongated edge and a second elongated edge;

said flap being secured by stitching adjacent its said first elongated edge to said second wall portion adjacent said second elongated edge of said second zipper track and extending therefrom inwardly of said second side wall portion and inwardly of said zipper tracks toward said first zipper track so that said second edge of said flap is positioned beyond said second elongated edge of said first zipper track when said opening has been closed such that said outer side of said flap faces and overlies said inner surface of said first wall portion;

an elongated flat strip of loop fastener material having a first edge and a second edge;

an elongated flat strip of hook fastener material having a first edge and a second edge;

said first edge of one of said loop fastener material and said hook fastener material being secured by stitching to said flap and to said edge of said second wall portion adjacent said second edge of said second zipper track;

said second edge of said one of said loop fastener material and said hook fastener material being secured by stitching to said outer side of said flap which faces the inner surface of said first wall portion, said second edge of said one of said loop fastener material and said hook fastener material being secured to a portion of said flap which can be positioned at said second edge of said first zipper track;

said first edge of the other of said strip of loop fastener material and said hook fastener material being secured by stitching to said inner surface of said first wall portion on said second side of said first zipper track at said end location;

said second edge of the other of said strip of loop fastener material and said hook fastener material being secured by stitching to said end of said first wall portion secured to said first zipper track;

said flap and said strip of said one of said loop fastener material and said hook fastener material providing a bed bug barrier at the inner side of the zipper teeth of said second zipper track when said zipper head is positioned at said end location;

the engagement of said strip of loop fastener material at said strip of hook fastener material forming an additional bed bug barrier above adjacent said zipper teeth of said first and second zipper tracks when said zipper head is positioned at said second end location of said opening.

16. The bed bug protective encasement according to claim 15, wherein said opening in said cover is formed in at least three of said four sides.

17. The bed bug protective encasement according to claim 15, wherein said strip of loop fastener material is secured to said flap.

* * * * *